US007858042B2

(12) United States Patent
Hwang et al.

(10) Patent No.: US 7,858,042 B2
(45) Date of Patent: Dec. 28, 2010

(54) MICROFLUIDIC CHIP AND METHOD OF FABRICATING THE SAME

(75) Inventors: Kyu-youn Hwang, Yongin-si (KR); Joon-ho Kim, Seongnam-si (KR); Chin-sung Park, Yongin-si (KR); Sung-young Jeong, Yongin-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 665 days.

(21) Appl. No.: 11/934,811

(22) Filed: Nov. 5, 2007

(65) Prior Publication Data

US 2008/0305011 A1 Dec. 11, 2008

(30) Foreign Application Priority Data

Jun. 7, 2007 (KR) ..... 10-2007-0055716

(51) Int. Cl.
*B01N 3/00* (2006.01)

(52) U.S. Cl. ..... 422/100; 427/154; 216/67; 430/324; 428/40.1

(58) Field of Classification Search ..... None
See application file for complete search history.

(56) References Cited

U.S. PATENT DOCUMENTS 7,351,303 B2 4/2008 Liu et al.
2003/0203271 A1 10/2003 Morse et al.
2006/0257627 A1 11/2006 Shim et al.

FOREIGN PATENT DOCUMENTS

WO 02/059590 A1 8/2002
WO 2007/078833 A2 7/2007
WO 2008/032128 A1 3/2008

OTHER PUBLICATIONS

Korea Patent Office Communication mailed Nov. 30, 2009 in KR application No. 10-2008-0110004.
Thuiller et al. "Development of a low cost hybrid Si/PDMS multi-layered pneumatic microvalve." Microsystems Technologies, Micro and Nanosystems Information Storage and Processing Systems, Germany, vol. 12, No. 1-2, Dec. 2005, pp. 180-185.
Lee et al. "A new method using photocatalytic lithography and selective atomic layer deposition" J. Am. Chem. Soc. 2004, vol. 126, pp. 28-29.
Kubo et al. "Mechanisms and Resolutions of Photocatalytic Lithography." J. Phys. Chem. B., vol. 108, 2004, pp. 3005-3009.

*Primary Examiner*—Jill Warden
*Assistant Examiner*—Timothy G Kingan
(74) *Attorney, Agent, or Firm*—Sughrue Mion, PLLC

(57) ABSTRACT

Provided are a microfluidic chip and a method of fabricating the same. The microfluidic chip includes: a lower substrate; an upper substrate formed of a silicone resin, wherein the lower substrate and the upper substrate, bonded together, provide a channel through which a fluid can flow and a chamber to receive the fluid; and an organic thin film formed on the upper surface of the lower substrate except for portions on which the lower substrate and the upper substrate are attached to each other.

14 Claims, 14 Drawing Sheets

MICROFLUIDIC CHIP AND METHOD OF FABRICATING THE SAME

CROSS-REFERENCE TO RELATED PATENT APPLICATIONS

This application claims the benefit of Korean Patent Application No. 10-2007-0055716 filed on Jun. 7, 2007, in the Korean Intellectual Property Office, the disclosure of which is incorporated herein in its entirety by reference.

BACKGROUND OF THE INVENTION

1. Field of the Invention

The present invention relates to microfluidics, and more particularly, to a microfluidic chip and a method of fabricating the microfluidic chip.

2. Description of the Related Art

Microfluidic chips, which are chip-shaped devices, are used in microfluidics to perform various biochemical reactions using a small amount of biochemical fluid or to process a biochemical fluid for biochemical reactions. In general, a microfluidic chip includes an inlet hole for injecting a biochemical fluid into the microfluidic chip, an outlet hole for discharging the biochemical fluid out of the microfluidic chip, a channel through which the biochemical fluid can flow, and a chamber in which the biochemical fluid is received.

Microfluidic chips, which have the organic thin films on an inner surface of the chamber using an organosilane-based material in order to capture the cells present in a biochemical fluid or to purify DNA extracted from the cells, are known. Such a conventional microfluidic chip includes a lower substrate formed of silicon (Si) and an upper substrate formed of a transparent glass material, and the lower substrate and the upper substrate are bonded to each other. An anodic bonding method may be used to bond the lower and upper substrates together. However, the anodic bonding requires a high temperature condition of 400° C. or higher, which may cause destruction or an organosilane-based material. Therefore, the conventional microfluidic chips having organic thin films have been manufactured forming the organic thin films through the holes on inner surfaces of the chamber and the channel using a chemical vapor deposition (CVD) method, after bonding the lower and supper substrates together.

The conventional microfluidic chip uses the expensive inorganic materials such as silicon or glass, and the lower substrate and the upper substrate are attached to each other using the anodic bonding method that requires the high temperature condition. In addition, since the organic thin film should be formed through the holes after attaching the lower substrate and the upper substrate to each other, the fabrication costs of the conventional microfluidic chip increase and the uniformity of generated organic thin film may not be guaranteed.

SUMMARY OF THE INVENTION

The present invention provides a microfluidic chip including a lower substrate and an upper substrate attached to each other using a novel bonding method instead of an anodic bonding, and including an organic thin film formed on an inner surface of a chamber, and a method of fabricating the microfluidic chip.

According to an aspect of the present invention, there is provided a microfluidic chip including: a first substrate having a first surface and a second surface that is opposite to the first surface, the first substrate including a first sunken area of a first depth and a second sunken area of a second depth, each formed on the first surface, wherein the second depth is greater than the first depth and the first sunken area and the second sunken area being fluid communicated to each other; a second substrate having a first surface and a second surface that is opposite to the first surface, the second substrate being formed of a silicone resin, wherein the first surface of the second substrate is attached to the first surface of the first substrate in a way to provide a channel which forms a passage of flow of a fluid and a chamber to receive the fluid, wherein the channel is provided by the first sunken area of the first substrate and the chamber is provided by the second sunken area of the first substrate; and an organic thin film formed on the first surface of the first substrate except for portions where the first substrate is in contact with the second substrate, wherein the first surface of the second substrate is treated by an $O_2$-plasma process.

The microfluidic chip may further include: a unit for increasing a contact surface area with the fluid in the chamber.

The unit for increasing the contact surface area may include a plurality of pillars protruding from a bottom surface of the second sunken area of the first substrate, wherein a top surface of the pillars is on a same plane to the first surface of the first substrate and is in contact with the first surface of the second substrate; and wherein the pillars are disposed with space from one another.

The organic thin film may be formed on a surface of the unit for increasing the contact surface area.

The silicone resin of the first substrate may be a PDMS (polydimethylsiloxane).

The second substrate may include Si, $SiO_2$, SiN, or a polymer.

The organic thin film may be a SAM (self-assembled monolayer).

The organic thin film may include an organosilane-based material.

The organosilane-based material may have an alkoxysilane group or a chlorosilane group.

A photocatalyst layer including a photocatalyst material may be disposed between the first substrate and the organic thin film.

The photocatalyst material in the photocatalyst layer may be $TiO_2$, ZnO, $SnO_2$, $SrTiO_3$, $WO_3$, $B_2O_3$, or $Fe_2O_3$.

The first substrate may include a photocatalyst material.

The photocatalyst material contained in the first substrate may be $TiO_2$.

The microfluidic chip may further comprises an oxide layer or a nitride layer formed on portions of the first surface of the first substrate, where the first surface of the first substrate is in contact with the first surface of the second substrate; wherein the oxide layer or the nitride layer of the first surface of the first substrate contacts the first surface of the second substrate.

The oxide layer may include $SiO_2$ or $TiO_2$.

The nitride layer may include SiN.

According to another aspect of the present invention, there is provided a method of fabricating a microfluidic chip, the method including: forming a first substrate having a first surface and a second surface that is opposite to the first surface, the first substrate including a first sunken area of a first depth and a second sunken area of a second depth, each formed on the first surface, wherein the second depth is greater than the first depth and the first sunken area and the second sunken area being fluid communicated to each other; forming a second substrate having a first surface and a second surface that is opposite to the first surface, the second substrate being formed of a silicone resin; forming an organic thin film on the first surface of the first substrate; removing a part of the organic thin film from areas of the first surface of the first substrate, the areas to be contact with to the first surface of the second substrate; treating the first surface of the second substrate using an $O_2$-plasma process; and adhering the first surface of the second substrate to the first surface of the first substrate to give the microfluidic chip provided with a channel which forms a passage of flow of a fluid and a chamber to receive the fluid, wherein the channel is provided by the first sunken area of the first substrate and the chamber is provided by the second sunken area of the first substrate.

The formation of the organic thin film may include: coating the first substrate with a solution including an organic thin film-forming material.

The removal of the organic thin film may include: forming a photo mask which includes a flat transparent plate, a patterned photoresist layer, and a photocatalyst layer including a photocatalyst material, wherein the patterned photoresist layer is formed on one surface of the flat transparent plate and the photocatalyst layer is formed on an opposite surface of the transparent plate; aligning the photo mask onto the first surface of the first substrate to bring the photocatalyst layer in contact with the organic thin film of the first surface of the first substrate; and irradiating rays to the photo mask to decompose parts of the organic thin film that contact the photocatalyst layer.

The removal of the organic thin film may include: placing a patterned flat photocatalyst plate including a photocatalyst material on the first substrate on which the organic thin film is formed; and irradiating rays to the photocatalyst plate to decompose parts of the organic thin film that contacts the photocatalyst plate.

The method may further include: forming a photocatalyst layer including a photocatalyst material on the first surface of the first substrate, prior to the forming of the organic thin film so that the organic thin film is formed on the photocatalyst layer, wherein the removing of the organic thin film comprises: forming a photo mask including a flat transparent plate and a patterned photoresist layer formed on the transparent plate; aligning the photo mask on the first surface of the first substrate; and irradiating rays to the photo mask to decompose parts of the organic thin film that contact the photocatalyst layer.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

Hereinafter, a microfluidic chip and a method of fabricating the same according to the present invention will be described with reference to accompanying drawings.

Figure 1:
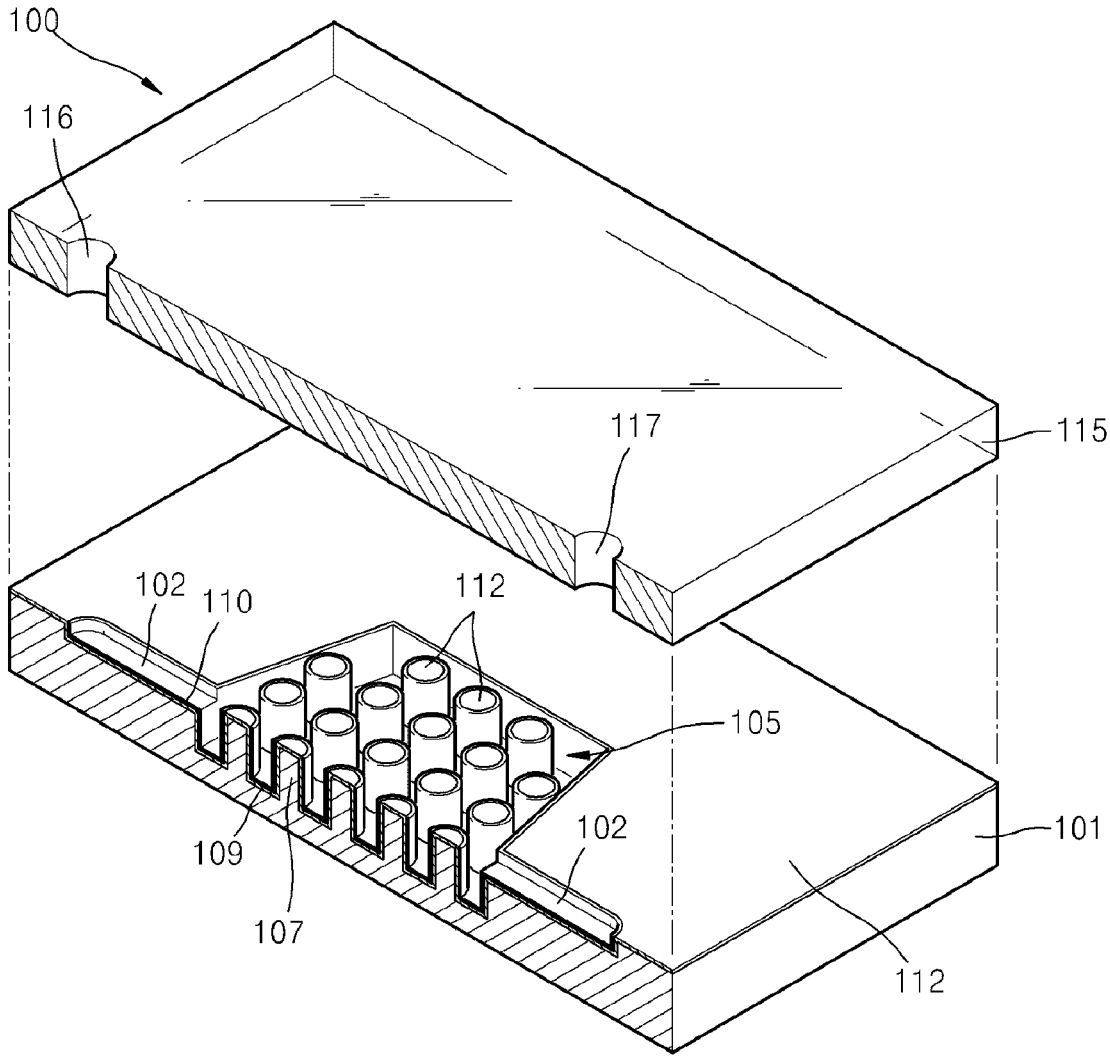
FIG. 1 is a partially cut exploded perspective view of a microfluidic chip according to an embodiment of the present invention

FIG. 1 is a partially cut exploded perspective view of a microfluidic chip 100 according to an embodiment of the present invention.

Referring to FIG. 1, the microfluidic chip 100 of the current embodiment includes a lower substrate 101 and an upper substrate 115, which are attached to each other. The lower substrate 101, which has a certain thickness and has an upper surface and a lower surface, is formed of a Si material, and includes a first sunken area of a first depth and a second sunken area of a second depth, each formed on the first surface, wherein the second depth is greater than the first depth and the first sunken area and the second sunken area being fluid communicated to each other. When the lower substrate 101 is attached to the upper substrate 115, the first and second sunken areas each provide a channel 102 which forms a passage of flow of a fluid and a chamber 105 to receive the fluid, respectively. A plurality of pillars 107 are formed in the chamber 105. The pillar 107 is provided for increasing a surface area contacting the fluid introduced in the chamber 105. The pillars 107 are located with space from each other in the chamber 105, and protrude from a bottom surface of the chamber 105 to have a height so that their top surface is on the same plane to the upper surface of the lower substrate 101. Thus, the top surface of the pillars 107 is in contact with the lower surface (or inner surface) of the upper substrate 115 when the upper substrate 115 is bonded to the lower substrate 101.

The surface of the lower substrate 101, which is formed of the Si material, is oxidized by oxygen in the air, and thus, an oxide layer 109 including $SiO_2$ is spontaneously formed. The oxide layer covers the entire surface of the upper surface of the lower substrate 101 in a way to cover the surface of the channel 102, chamber 105, and pillars 107, as shown in FIG. 1. The oxide layer 109 has a function of attaching the upper substrate 115 and the lower substrate 101 to each other. On the other hand, the lower substrate 101 may be formed of a polymer resin such as PDMS (polydimethylsiloxane), PMMA (polymethylmetaacrylate), PC (polycarbonate), and PE (polyethylene). If the lower substrate 101 is formed of the polymer resin, the oxide layer 109 is not automatically formed. Therefore, an oxide layer including $SiO_2$ or $TiO_2$ or a nitride layer including SiN should be artificially formed. In order to form the oxide layer or the nitride layer, a CVD method or a physical vapor deposition (PVD) method can be used. In addition, the lower substrate 101 may be formed of $SiO_2$ or SiN. In this case, since the lower substrate 101 is formed of the oxide material or the nitride material, an additional oxide layer or a nitride layer is not required.

An organic thin film 110 is formed on the oxide layer 109 (or directly on the upper surface of the lower substrate 101, when the lower substrate 101 is made of $SiO_2$ or SiN). The organic thin film 110 is coated to capture in the chamber 105 certain cells such as bacteria included in a biochemical fluid injected into the microfluidic chip 100 or to purify DNA extracted from the cells in the chamber 105. The organic thin film 110 may include an organosilane-based material, and can be stacked as a self-assembled monolayer. The organic thin film 110 is also formed on surfaces of the plurality of pillars 107. The organosilane-based material can be an alkoxysilane group material or a chlorosilane group material. The alkoxysilane group material can be octadecyldimethyl(3-trimethoxysilyl propyl) ammonium chloride, polyethyleneiminertrimethoxysilane, and aminopropyltriethoxysilane, and the chlorosilane group material can be octadecyltrichlorosilane.

The organic thin film 110 is mostly formed of a hydrophobic material, and thus, interferes with the attachment between the lower substrate 101 and the upper substrate 115. Therefore, the organic thin film formed on areas 112 on the upper surface of the lower substrate 101, which are to be attached to the upper substrate 115, is removed. Hereinafter, the area 112 will be referred to as an attaching area.

The upper substrate 115 is formed of a silicone resin, for example, PDMS (polydimethylsiloxane). The upper substrate 115 includes an inlet hole 116 connected to a side of the channel 102 of the chamber 105 so as to introduce a fluid (e.g. biochemical fluid) into the microfluidic chip 100, and an outlet hole 117 connected to the other side of the channel 102 of the chamber 105 so as to exhaust the fluid out of the microfluidic chip 100. The method of attaching the lower substrate 101 and the upper substrate 115 will be described hereinafter.

FIGS. 2A through 2G are cross-sectional views sequentially illustrating steps of fabricating the microfluidic chip of FIG. 1. Hereinafter, the method of fabricating the microfluidic chip 100 will be described in detail with reference to FIGS. 2A through 2G.

The method of fabricating the microfluidic chip 100 may include a first process (refer to FIG. 2A) of forming the lower substrate 101 which is provided with the channel 102 and the chamber 105 on its one surface, a second process (refer to FIG. 2F) of preparing the upper substrate 115, which is formed of Si according to the current embodiment, a third process (refer to FIG. 2B) of forming the organic thin film 110 on the upper surface of the lower substrate 101, a fourth process (refer to FIGS. 2C through 2E) of removing the organic thin film 110 from the attaching area 112 of the lower substrate 101, and a fifth process (refer to FIG. 2G) of attaching the upper substrate 115 and the lower substrate 101 to each other.

Figure 2A:
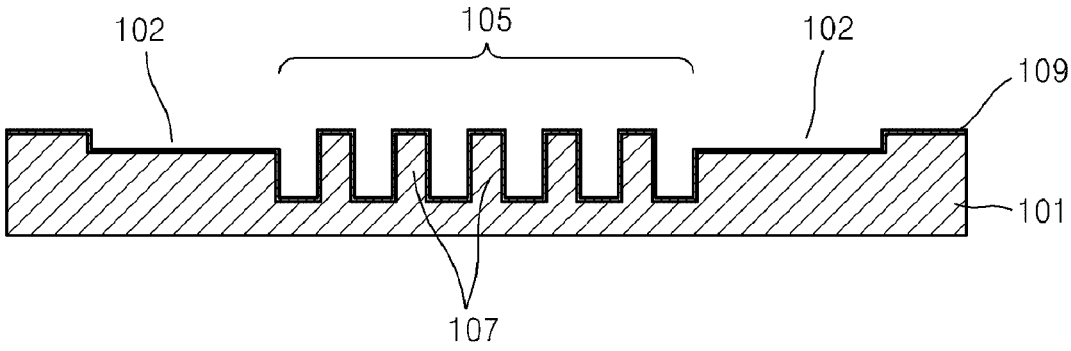
FIGS. 2A through 2G are cross-sectional views illustrating steps of fabricating the microfluidic chip of FIG. 1, in accordance with an embodiment of the present invention.

Referring to FIG. 2A, the lower substrate 101 formed of the Si material is prepared, and the channel 102, the chamber 105, and the plurality of pillars 107 are formed on the upper surface of the lower substrate 101. An etch prevention layer (not shown) having patterns corresponding to the channel 102, the chamber 105, and the pillars 107 is formed on the upper surface of the lower substrate 101 using a photolithography method, and the upper surface of the lower substrate 101 is selectively etched using a wet etching process or a dry etching process to form the channel 102, the chamber 105, and the pillars 107. On the other hand, the channel 102, the chamber 105, and the pillars 107 can be formed using a general machining process such as a press process or a milling process.

The surface of the lower substrate 101, on which the channel 102, the chamber 105, and the pillars 107 are formed, is oxidized by the oxygen in the air, resulting in the formation of the oxide layer 109 including $SiO_2$. The oxide layer 109 helps the attachment between the upper substrate 115 and the lower substrate 101. Meanwhile, the lower substrate 101 can be formed of a polymer resin such as PDMS (polydimethylsiloxane), PMMA (polymethylmetaacrylate), PC (polycarbonate), and PE (polyethylene). If the lower substrate 101 is formed of the polymer resin, the oxide layer 109 is not spontaneously formed, and thus, an additional step of forming an oxide layer including $SiO_2$ or $TiO_2$ or the nitride layer including SiN may be performed. The oxide layer or the nitride layer can be formed using the CVD method or the PVD method.

Figure 2B:
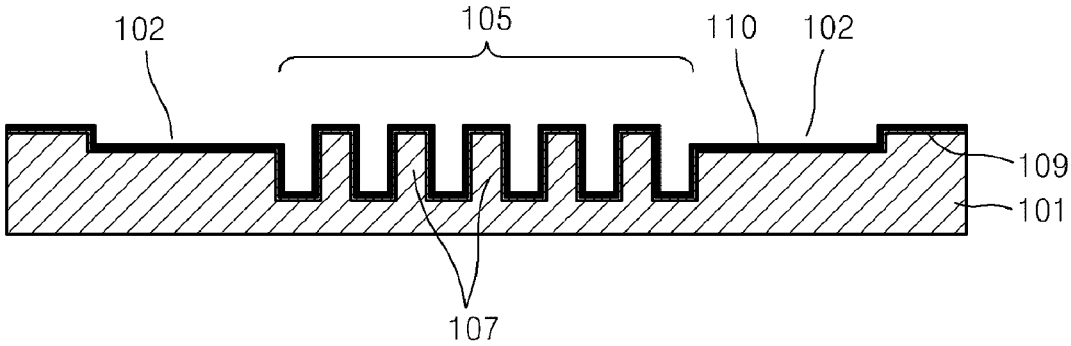
Figure 2C:
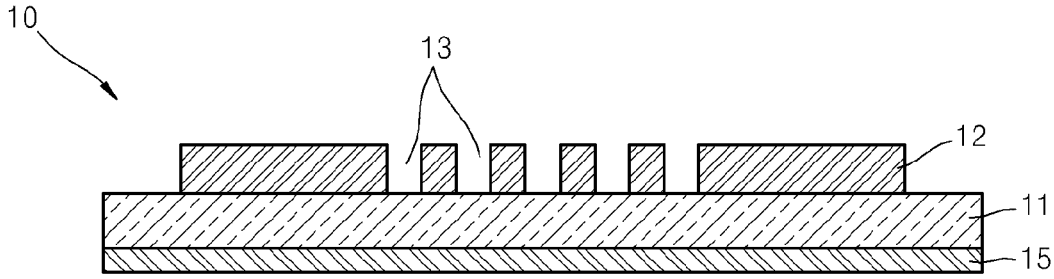
Figure 2D:
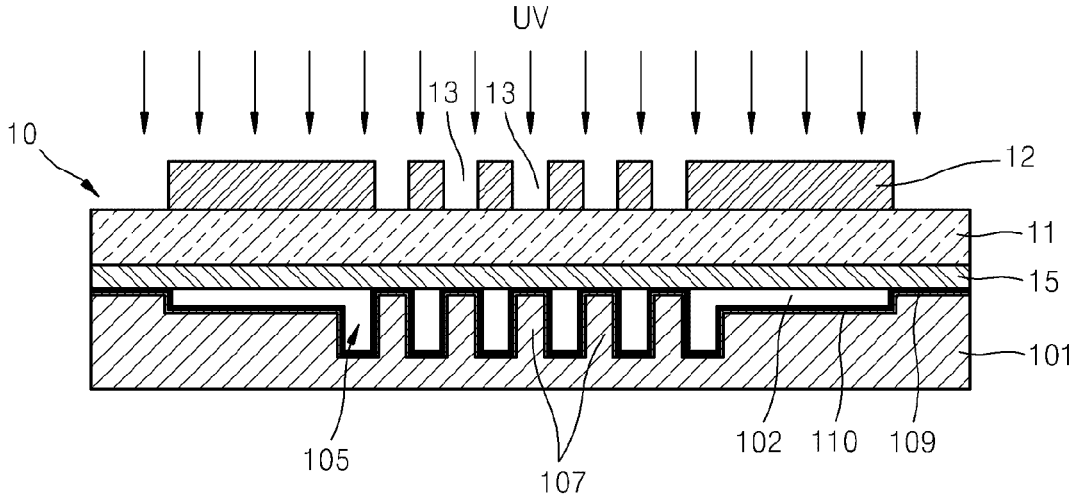
Figure 2E:
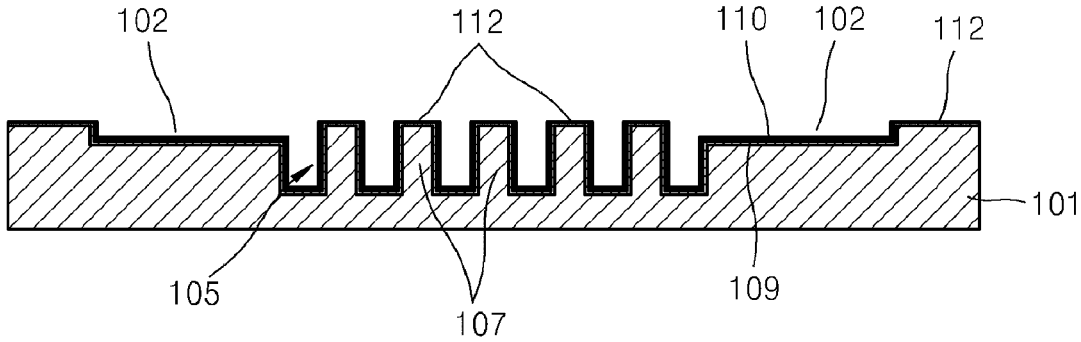
Figure 2F:
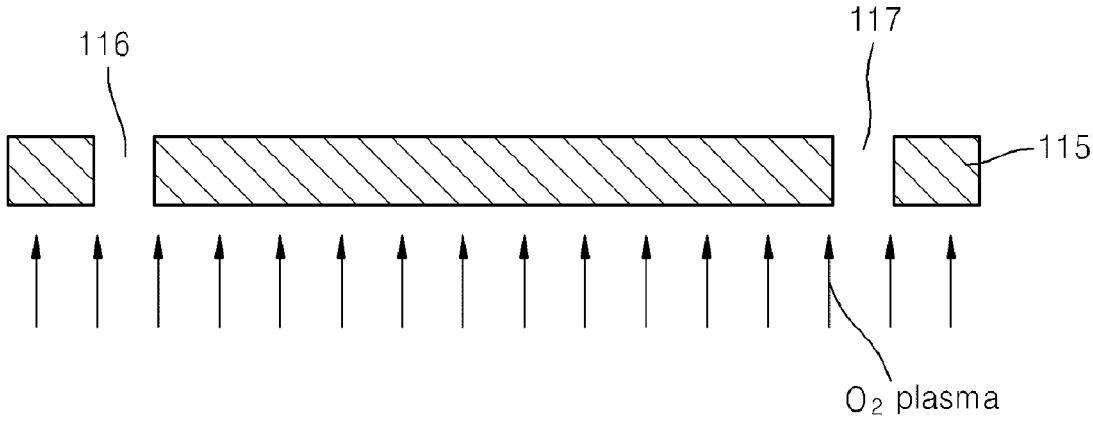

In a separate process (referred to as "second process" for convenience), a mixture of a silicone resin (e.g., PDMS resin) and a linking agent is injected into a mold (not shown) corresponding to the shape of the upper substrate 115 and is cured, and then, the cured shape is separated from the mold to form the upper substrate 115 (refer to FIG. 2F). The mixture of a silicone resin and a linking agent is commercially available. For example, SYLGARD® 184 of Dow Coming Inc. may be employed. In more detail, the optimal curing condition of Sylgard® 184 is to keep the product for about 45 minutes at a temperature of about 100° C., about 20 minutes at a temperature of about 125° C., or about 10 minutes at a temperature of about 150° C. Thus cured upper substrate may be further subject to $O_2$ plasma treatment, as will be described hereinafter.

The inlet hole 116 and the outlet hole 117 can be formed using a general machining process such as a pressing process or a drilling process. Otherwise, a structure corresponding to the inlet hole 116 and the outlet hole 117 is disposed in the mold, and the mixture of the PDMS resin and the linking agent is injected into the mold to form the inlet hole 116 and the outlet hole 117.

Referring to FIG. 2B, the third process includes a coating of an organic thin film 110. The coating may be performed by known methods. For example, the lower substrate 101 may be dipped into a solution including an organic thin film-forming material so that the upper surface of the lower substrate 101 may be covered with the material. In more detail, the upper surface of the lower substrate 101 is dipped into a solution including ethanol and an organosilane-based material (e.g., octadecyldimethyl(3-trimethoxysilyl propyl) ammonium chloride) for one hour, and after that, the lower substrate 101 is washed and disposed for about 50 minutes at a temperature of about 100° C. to form the organic thin film 110 on the upper surface of the lower substrate 101. In addition to octadecyldimethyl(3-trimethoxysilyl propyl) ammonium chloride, polyethyleneiminertrimethoxysilane, aminopropyltriethoxysilane, or octadecyltrichlorosilane may be used as the organic thin film-forming material.

The fourth process includes forming of a photomask 10 (refer to FIG. 2C), arranging the photomask 10 on the upper surface of the lower substrate 101 and irradiating ultraviolet rays onto the photomask 10 (refer to FIG. 2D), and removing the organic thin film 110 from the attaching area 112 on substrate 101 (refer to FIG. 2E).

Referring to FIG. 2C, the photomask 10 includes a flat transparent plate 11 formed of a transparent material such as glass, a photoresist layer 12 formed on the transparent plate 11, and a photocatalyst layer 15 formed on a surface of the transparent plate 11, which is opposite to the surface where the photoresist layer 12 is provided. The photoresist layer 12 includes a pattern 13 corresponding to the area, from which the organic thin film 110 will be removed, of the lower substrate 101, that is, the attaching area (112, refer to FIG. 1). The photoresist layer 12 including the pattern 13 may be formed by spin coating a liquid type photoresist on the transparent plate 11 and performing an exposure, a development, and a baking process to remove a certain area. Alternatively, it may be formed by laminating a film type photoresist on the transparent plate 11, and performing the exposure and the development process to remove a certain area.

The photocatalyst layer 15 is formed of a photocatalyst material. The photocatalyst material is a material causing a decomposition of the organic thin film 110 when it is exposed to ultraviolet rays while it is in contact with the organic thin film 110. For example, the photocatalyst material can be $TiO_2$, ZnO, $SnO_2$, $SrTiO_3$, $WO_3$, $B_2O_3$, or $Fe_2O_3$. The photocatalyst layer 15 can be formed by spin coating $TiO_2$-sol solution on the lower surface of the transparent plate 11, and baking the coated layer. The $TiO_2$-sol solution can be formed by mixing titanium isopropoxide, isopropanol, and 0.1N-HCl, and stabilizing the mixed solution. Otherwise, the photocatalyst layer 15 can be formed using the CVD method or the PVD method.

Referring to FIG. 2D, the photomask 10 is arranged on the upper surface of the lower substrate 101 so that the pattern 13 of the photoresist layer 12 is aligned with the respective attaching area 112 (refer to FIG. 1), and ultraviolet rays (UV) are irradiated thereon. The regions of the lower substrate 101 contacting the photocatalyst layer 15 correspond to the attaching area 112. When the UV rays are irradiated onto the photomask 10, the photocatalyst layer 15 and the organic thin film 110 are partially exposed to the UV rays through the pattern 13. Therefore, the part of the organic thin film 110, which contacts the photocatalyst layer 15 and is exposed to the UV rays, is decomposed by the photocatalyst material.

Referring to FIG. 2E, when the photomask 10 is separated from the lower substrate 101 after irradiating the UV rays, the attaching area 112, from which the organic thin film 110 is removed by the decomposition operation of the photocatalyst material, is exposed.

Figure 2G:
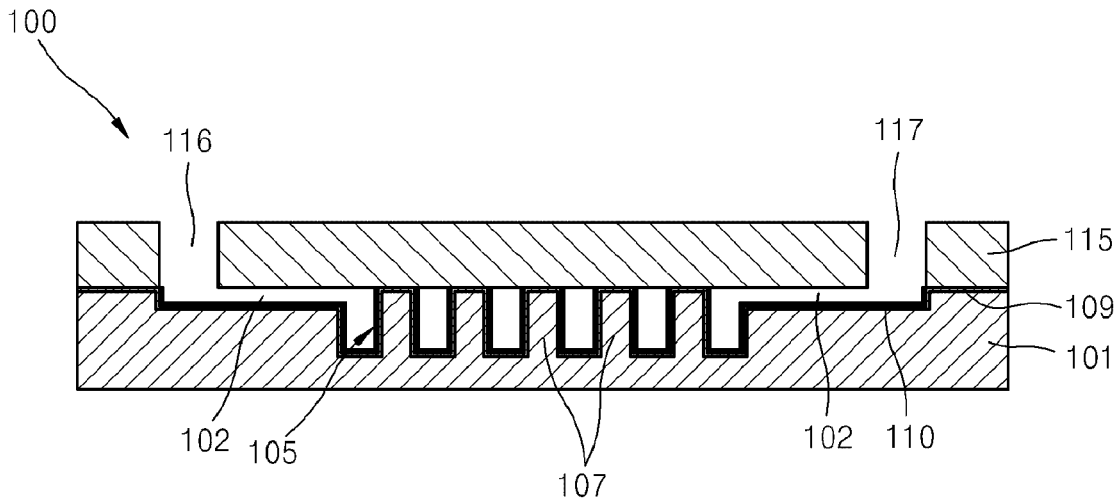

Referring to FIG. 2F, the fifth process includes activating the lower surface of the upper substrate 115 so as to be easily attached to the lower substrate 101. The activation may be carried out by performing an $O_2$-plasma process on the lower surface of the upper substrate 115. In the $O_2$-plasma process, $O_2$-plasma particles are collided to the lower surface of the upper substrate 115. Next, as shown in FIG. 2G, the lower surface of the upper substrate 115 is adhered to the upper surface of the lower substrate 101 to be attached, and thus, the microfluidic chip 100 is formed. When the exposed oxide layer 109 of the attaching area 112 (refer to FIG. 2E) of the lower substrate 101 is brought to contact with the $O_2$-plasma processed lower surface of the upper substrate 115, the contact surfaces of the substrates 101 and 115 are attached to each other by a dehydration-condensation.

Figure 3A:
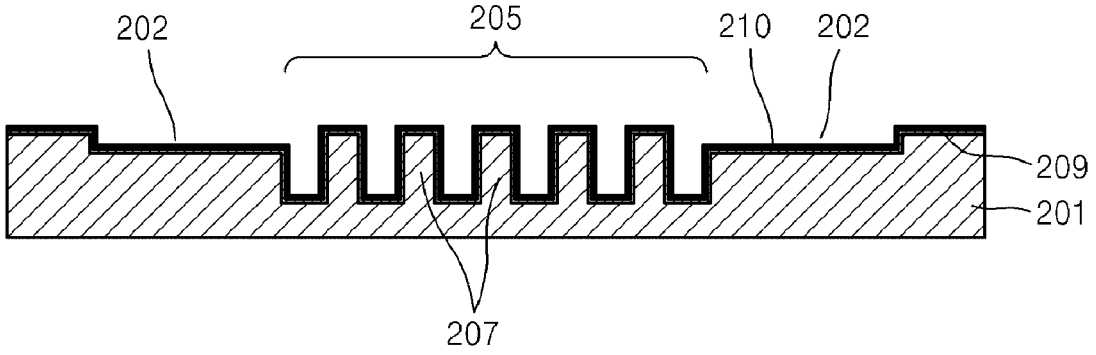
FIGS. 3A through 3E are cross-sectional views illustrating steps of fabricating a microfluidic chip, according to another embodiment of the present invention.
Figure 3B:
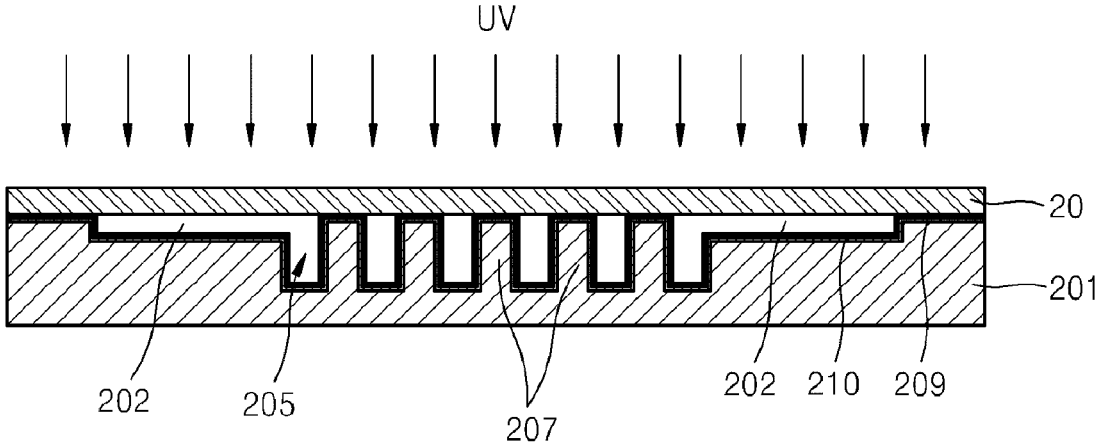
Figure 3C:
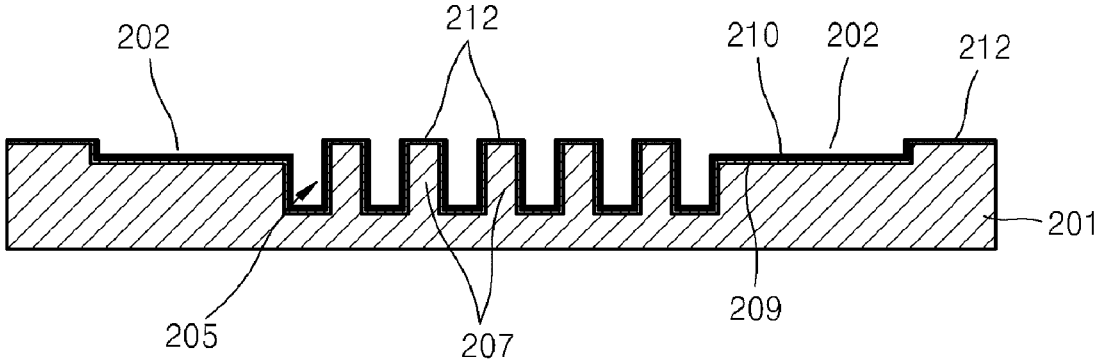
Figure 3D:
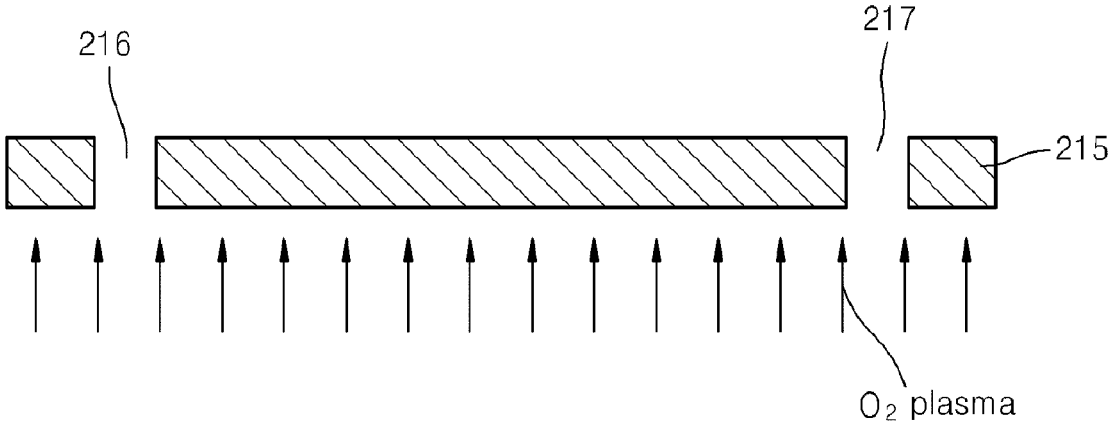
Figure 3E:
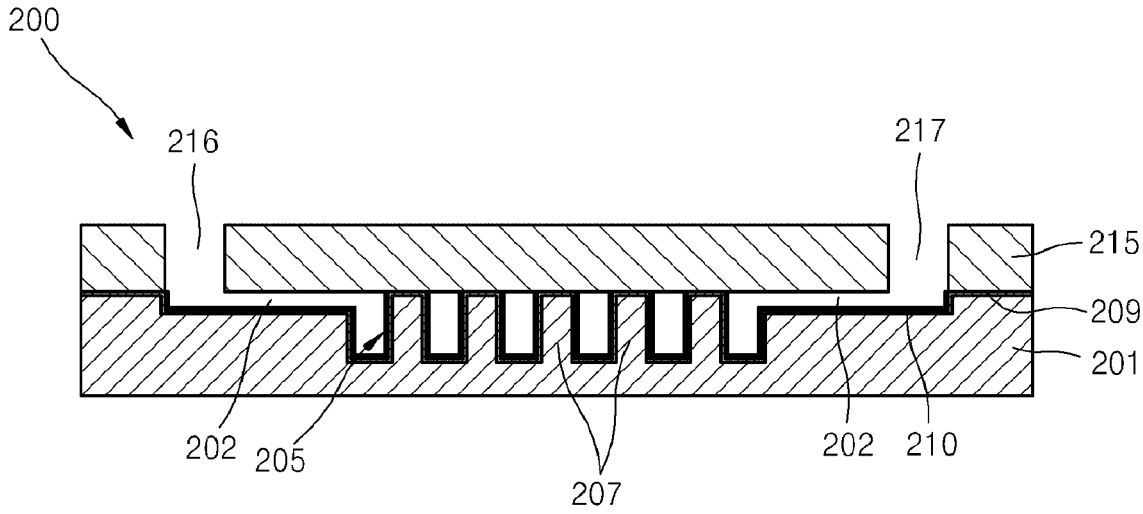

FIGS. 3A through 3E are cross-sectional views sequentially illustrating a method of fabricating a microfluidic chip according to another embodiment of the present invention. The fabrication method shown in FIGS. 3A through 3E may include a first process of preparing a lower substrate 201 on which a channel 202 and a chamber 205 are formed, a second process of forming an upper substrate 215, a third process of forming an organic thin film 210 on an upper surface of the lower substrate 201, a fourth process of removing the organic thin film 210 from an attaching area 212 of the upper surface of the lower substrate 201, and a fifth process of attaching the upper substrate 215 and the lower substrate 201 to each other. The first and third processes are shown in FIG. 3A, the fourth process is shown in FIGS. 3B and 3C, and the second process and the fifth process are shown in FIGS. 3D and 3E.

The first process and the third process are the same as the first and third processes for fabricating the microfluidic chip 100 described with reference to FIGS. 2A and 2B, and detailed descriptions for the above processes are omitted. Reference numeral 207 of FIG. 3A denotes a pillar, and reference numeral 209 denotes a $SiO_2$-containing oxide layer. The second process is the same as the second process for fabricating the microfluidic chip 100 described with reference to FIG. 2F, and detailed descriptions of the above process are omitted. Reference numeral 216 of FIG. 3D denotes an inlet hole, and reference numeral 217 denotes an outlet hole.

The fourth process includes placing a flat photocatalyst plate 20 on the lower substrate 201 and irradiating UV rays onto the photocatalyst plate 20 (refer to FIG. 3B), and washing the lower substrate 201 to remove the organic thin film 210 from the attaching area 212 (refer to FIG. 3C). Referring to FIG. 3B, the photocatalyst plate 20 includes a photocatalyst material. The photocatalyst material causes a decomposition of the organic thin film 210 when it is exposed to UV rays while it is in contact with the organic thin film 210. Examples of such photocatalyst material include, but not limited to, $TiO_2$, ZnO, $SnO_2$, $SrTiO_3$, $WO_3$, $B2O_3$, or $Fe_2O_3$. Portions of the lower substrate 201, which contact the photocatalyst plate 20, correspond to the attaching area 212 (refer to FIG. 3C).

When the UV rays are irradiated onto the photocatalyst plate 20, the photocatalyst plate 20 is exposed, and at the same time, parts of the organic thin film 210, which are in contact with the photocatalyst plate 20, are decomposed by the photocatalyst material. Referring to FIG. 3C, when the photocatalyst plate 20 is separated from the lower substrate 201 after irradiating the UV rays, the attaching area 212 has an exposed oxide layer due to the removal of the organic thin film 210.

Compared to the method explained with regard to FIGS. 2C through 2E which generates highly precise exposed areas on the attaching areas 112, the method shown in FIGS. 3B and 3C may produce relatively less precise exposed areas on the attaching areas 112, because the decomposition of the organic thin film 210 may be diffused to a peripheral portion of the contact area between the photocatalyst plate 20 and the organic thin film 210. Therefore, if a highly accurate microfluidic chip has to be fabricated, the microfluidic chip may be fabricated using the method shown in FIGS. 2A through 2G.

The fifth process includes activating a lower surface of the upper substrate 215 by performing an $O_2$-plasma process, in order to collide $O_2$-plasma to the lower surface of the upper substrate 215, as shown in FIG. 3D, and attaching the lower surface of the upper substrate 215 onto the upper surface of the lower substrate 201 to form the microfluidic chip 200 as shown in FIG. 3E.

Figure 4:
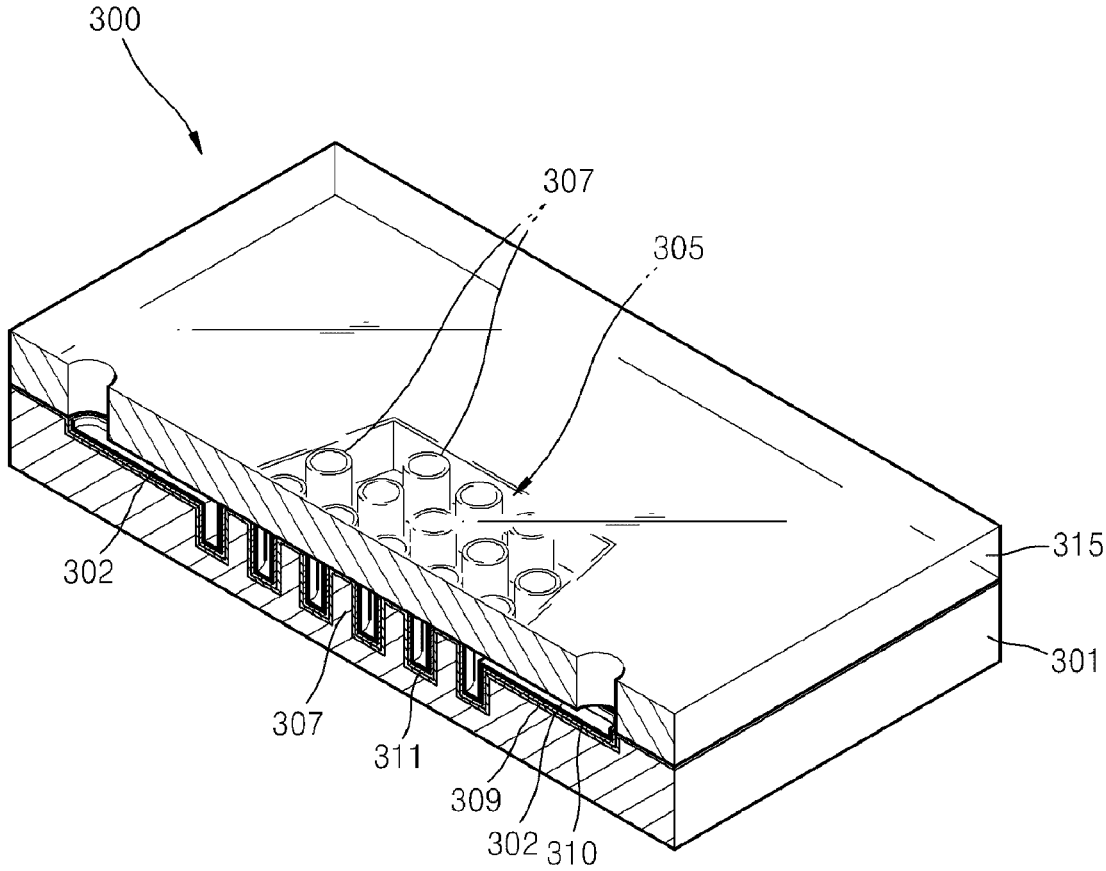
FIG. 4 is a partially cut perspective view of a microfluidic chip according to another embodiment of the present invention.

FIG. 4 is a partially cut perspective view showing a microfluidic chip 300 according to another embodiment of the present invention.

Referring to FIG. 4, the microfluidic chip 300 of the current embodiment also includes a lower substrate 301 and an upper substrate 315, which are attached to each other. In the current embodiment, the lower substrate 301 is formed of Si, and includes a channel 302, a chamber 305, and a plurality of pillars 307 on an upper surface thereof. The pillars 307 are arranged to be separated from each other in the chamber 305, and protrude from the upper surface of the lower substrate 301 to have a certain height and their top contact the lower surface of the upper substrate 315.

The surface of the lower substrate 301, which is formed of Si, is spontaneously oxidized by the oxygen in the air, and thus, an oxide layer 309 including $SiO_2$ is formed. On the other hand, if the lower substrate 301 is formed of a polymer such as PDMS (polydimethylsiloxane), PMMA (polymethylmetaacrylate), PC (polycarbonate), and PE (polyethylene), an additional step may be performed to form an oxide layer including $SiO_2$ or $TiO_2$ or a nitride layer including SiN.

A photocatalyst layer 311 including a photocatalyst material is deposited on the oxide layer 309. The photocatalyst material can be $TiO_2$, ZnO, $SnO_2$, $SrTiO_3$, $WO_3$, $B_2O_3$, or $Fe_2O_3$. An organic thin film 310 is formed on the photocatalyst layer 311. The organic thin film 310 is the same as the organic thin film 110 included in the microfluidic chip 100 of FIG. 1, and detailed descriptions for the organic thin film 310 are omitted. The organic thin film formed on an attaching area 312 (refer to FIG. 5E) on the upper surface of the lower substrate 301 is removed to expose the oxide layer.

The upper substrate 315 is formed of a silicone resin, for example PDMS (polydimethylsiloxane). The upper substrate 315 includes an inlet hole 316 and an outlet hole 317.

FIGS. 5A through 5G are cross-sectional views illustrating a method of fabricating the microfluidic chip shown in FIG. 4. The method of fabricating the microfluidic chip 300 includes a first process of preparing the lower substrate 301 including the channel 302 and the chamber 305, a second process of preparing the upper substrate 315, a third process of forming the organic thin film 310 on the upper surface of the lower substrate 301, a fourth process of removing the organic thin film 310 formed on the attaching area 312 of the lower substrate 301, and a fifth process of attaching the upper substrate 315 and the lower substrate 301 to each other. In addition, the method of the current embodiment can further include a process of forming a photocatalyst layer 311 on the upper surface of the lower substrate 301 prior to carrying out the third process.

Figure 5A:
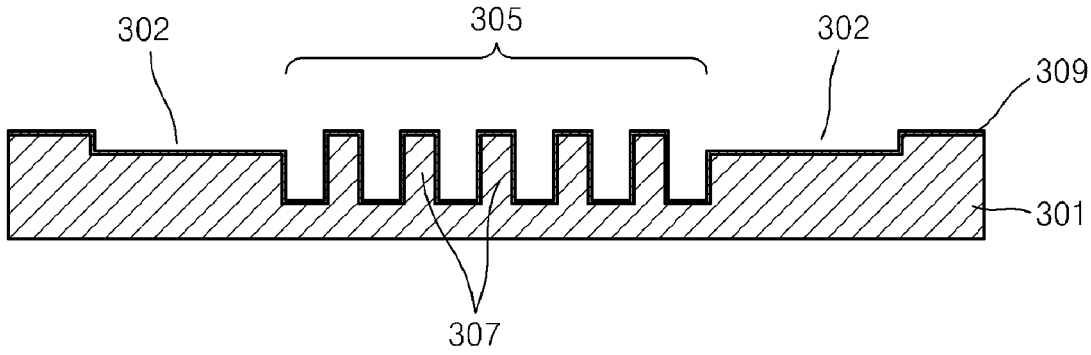
FIGS. 5A through 5G are cross-sectional views sequentially illustrating steps of fabricating the microfluidic chip of FIG. 4, according to another embodiment of the present invention.

Referring to FIG. 5A, the first process includes preparing the lower substrate 301 formed of Si, and forming the channel 302, the chamber 305, and the plurality of pillars 307 on the upper surface of the lower substrate 301. The first process is the same as the first process for fabricating the microfluidic chip 100 described with reference to FIG. 2A, and thus, detailed descriptions for the first process are omitted here. In the second process, a mixture of the PDMS resin and the linking agent is injected into a mold (not shown) corresponding to the shape of the upper substrate 315, and is cured and separated from the mold to form the upper substrate 315 (refer to FIG. 5F) including the PDMS. In addition, the inlet hole 316 and the outlet hole 317 can be formed in the upper substrate 315. The second process is also the same as the second process for fabricating the microfluidic chip 100 described with reference to FIG. 2F, and thus, detailed descriptions for the second process are omitted.

Figure 5B:
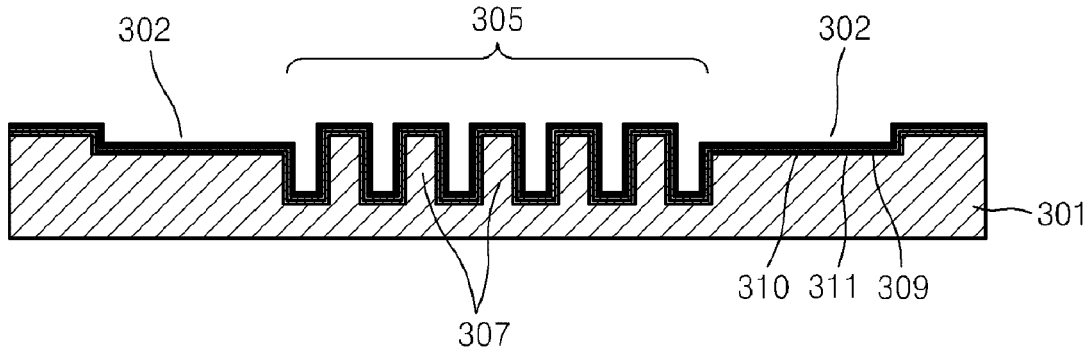

Referring to FIG. 5B, the photocatalyst layer 311 including the photocatalyst material is formed on the upper surface of the lower substrate 315. The photocatalyst layer 311 can be formed by spin-coating a solution including the photocatalyst material onto the lower substrate 301, and then, baking the coated solution. Alternatively, the photocatalyst layer 311 can be formed using the CVD method or the PVD method. In the third process, the organic thin film 310 is formed on the photocatalyst layer 311. The process of forming the organic thin film 310 is the same as the third process for fabricating the microfluidic chip 100 described with reference to FIG. 2B, and thus, detailed descriptions for the process are omitted.

Figure 5C:
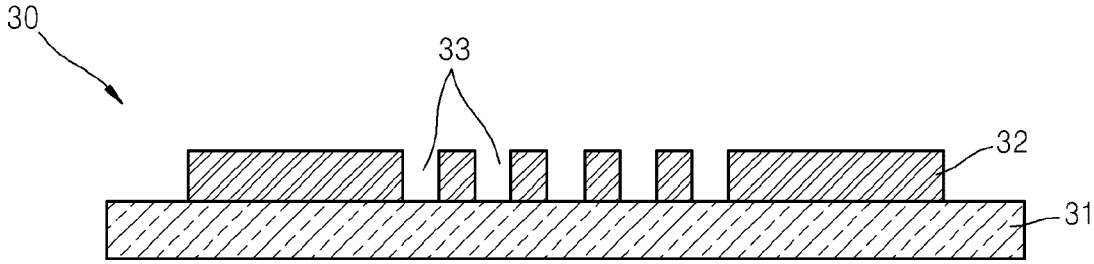
Figure 5D:
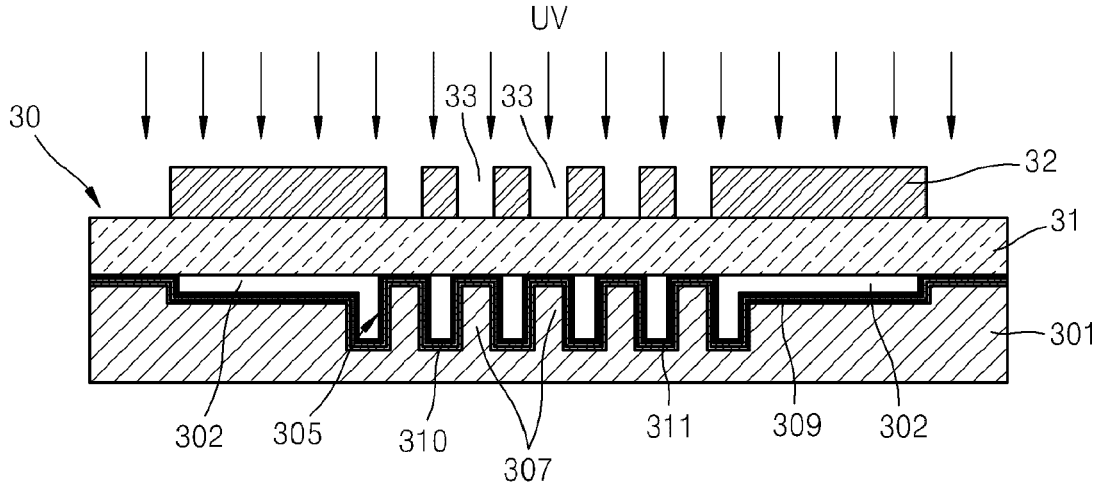
Figure 5E:
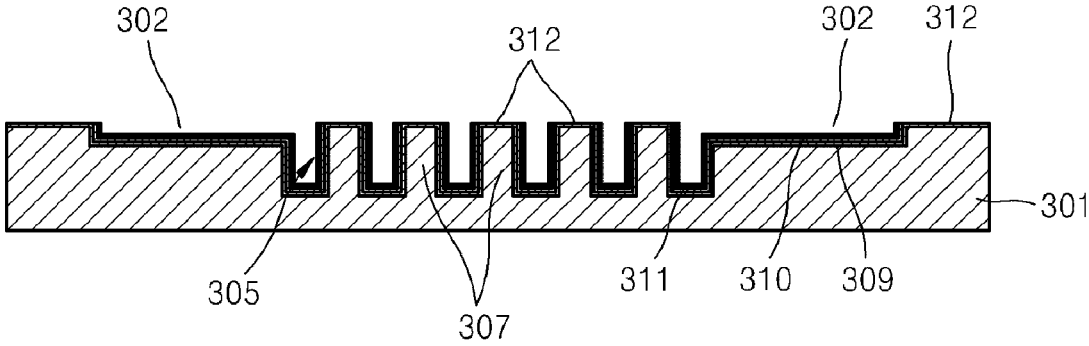

The fourth process includes forming a photo mask 30 (refer to FIG. 5C), arranging the photo mask 30 on the upper surface of the lower substrate and irradiating the UV rays onto the photo mask 30 (refer to FIG. 5D), and washing the lower substrate 301 to remove the organic thin film 310 from the attaching area 312 (refer to FIG. 5E).

Referring to FIG. 5C, the photo mask 30 includes a flat transparent plate 31 and a photoresist layer 32 formed on the transparent plate 31. The photoresist layer 32 includes a pattern 33 corresponding to portions (i.e., attaching area 312 in FIG. 5E) of the lower substrate 301 from which the organic thin film 310 will be removed. A method of forming the photoresist is the same as the method described with reference to FIG. 2C, and thus its detailed descriptions are omitted.

Referring to FIG. 5D, the photo mask 30 is arranged on the upper surface of the lower substrate 301 so that the pattern 33 of the photoresist layer 32 is aligned with the attaching area 312 (refer to FIG. 5F), and the UV ray is irradiated on the photo mask 30. When the UV rays are irradiated onto the photo mask 30, the organic thin film 310 and the photocatalyst layer 311 under the organic thin film 310 are partially exposed to the UV ray through the pattern 33. Therefore, parts of the organic thin film 310, which contact the photocatalyst layer 309 and are exposed to the UV ray, are decomposed by the photocatalyst material to expose the oxide layer 309.

Figure 5F:
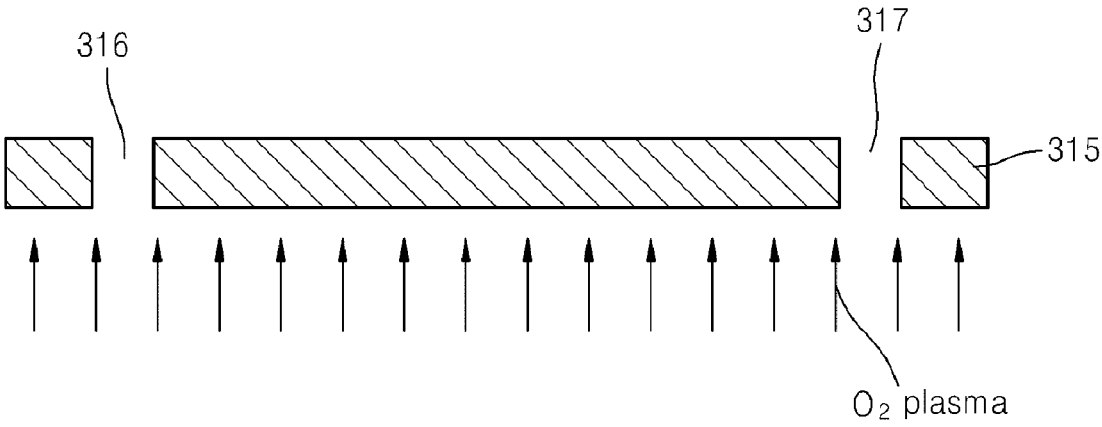
Figure 5G:
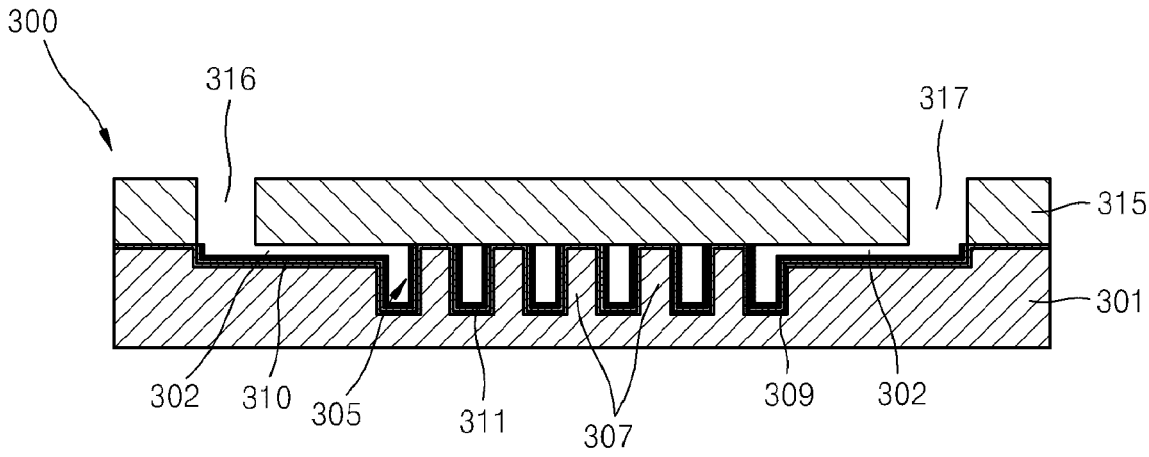

Referring to FIG. 5E, when the photo mask 30 is separated from the lower substrate 301 after irradiating the UV rays to the photo mask 30, the oxide layer 309 of the attaching area 312 is exposed by removing the organic thin film 310 from the lower substrate 301 due to the decomposition of the photocatalyst material. In the fifth process, an $O_2$-plasma process, in which $O_2$-plasma is collided to the lower surface of the upper substrate 315 formed in the second process, is performed to activate the lower surface of the upper substrate 315 as shown in FIG. 5F, and then, the lower surface of the upper substrate 315 is adhered to the upper surface of the lower substrate 301 to be attached to the lower substrate. Thus, the microfluidic chip 300 is formed as shown in FIG. 5G.

Figure 6:
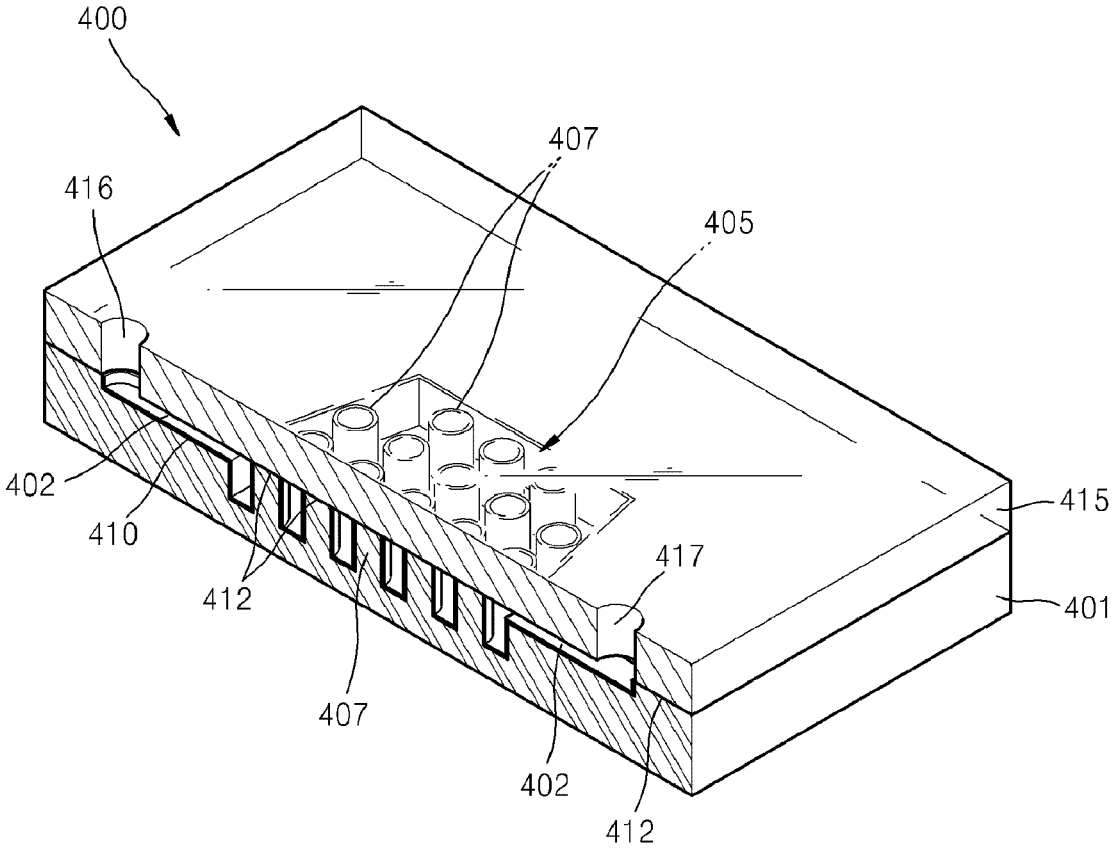
FIG. 6 is a partially cut perspective view of a microfluidic chip according to another embodiment of the present invention.

FIG. 6 is a partially cut perspective view showing a microfluidic chip according to another embodiment of the present invention.

Referring to FIG. 6, the microfluidic chip 400 according to the current embodiment also includes a lower substrate 401 and an upper substrate 415, which are attached to each other. The lower substrate 401 includes a photocatalyst material, and the photocatalyst material may be $TiO_2$. A channel 402, a chamber 405, and a plurality of pillars 407 are formed on an upper surface of the lower substrate 401. As described with reference to FIG. 2A, the channel 402, the chamber 405, and the pillars 407 can be formed using an etching process or a machining process.

Since $TiO_2$ is an oxide material that can help the attachment between the upper substrate 415 and the lower substrate 401, the lower substrate 401 does not require an additional oxide layer like the oxide layer 109 shown in FIG. 1. An organic thin film 410 is formed on the upper surface of the lower substrate 401. The organic thin film 410 can be formed using the same process for forming the organic thin film 110 described with reference to FIG. 2B, and thus, detailed descriptions for the process of forming the organic thin film 410 are omitted. The organic thin film 410 formed on an attaching area 415 of the upper surface of the lower substrate, which is attached to the upper substrate 415, is removed. The method of removing the organic thin film 410 is the same as the method described with reference to FIGS. 5C through 5E, that is, a photo mask including a flat transparent plate and a photoresist layer formed on the transparent plate is arranged on the lower substrate 401 and the UV ray is irradiated to the photo mask to partially decompose the organic thin film.

The upper substrate 415 is formed of a silicone resin, for example, PDMS (polydimethylsiloxane), and includes an inlet hole 416 and an outlet hole 417. As described with reference to FIGS. 5F and 5G, the lower surface of the upper substrate 415 is activated by performing the $O_2$-plasma process in order to enhance its bonding to the lower substrate 401, and then, the lower surface of the upper substrate 415 is adhered to the upper surface of the lower substrate 401 to attach the upper and lower substrates 415 and 401 to each other. Then, the microfluidic chip 400 is formed.

On the other hand, the inventor of the present invention performed cell capture experiments and polymerase chain reaction (PCR) experiments using the microfluidic chip 100 of the present invention ("inventive") or the conventional microfluidic chip having the lower substrate formed of Si and the upper substrate formed of a glass material ("comparative"), and compared the results of the experiments. Both the inventive and comparative chips produced substantially same results within an acceptable error range, and thus, it was reasonably determined that the microfluidic chip 100 of the present invention is suitable for use in microfluidics and can replace the conventional microfluidic chips.

According to the present invention, the microfluidic chip, in which the organic thin film is formed on the inner surfaces of the chamber, can be fabricated using a silicone resin that can be easily formed and is cheaper than the glass material. Therefore, the costs for fabricating the microfluidic chip can be reduced, and a defect rate can be reduced and a production yield can be improved by generating the organic thin film before the bonding process.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A method of fabricating a microfluidic chip, the method comprising:

forming a first substrate having a first surface and a second surface that is opposite to the first surface, the first substrate including a first sunken area of a first depth and a second sunken area of a second depth, each formed on the first surface, wherein the second depth is greater than the first depth and the first sunken area and the second sunken area being fluid communicated to each other;

forming a second substrate having a first surface and a second surface that is opposite to the first surface, the second substrate being formed of a silicone resin;

forming an organic thin film on the first surface of the first substrate;

removing a part of the organic thin film from areas of the first surface of the first substrate, the areas to be contact with to the first surface of the second substrate; treating the first surface of the second substrate using an $O_2$-plasma process; and adhering the first surface of the second substrate to the first surface of the first substrate to give the microfluidic chip provided with a channel which forms a passage of flow of a fluid and a chamber to receive the fluid, wherein the channel is provided by the first sunken area of the first substrate and the chamber is provided by the second sunken area of the first substrate.

2. The method of claim 1, wherein the forming of the first substrate comprises:

forming a plurality of pillars that protrude from a bottom surface of the second sunken area of the first substrate so that a top surface of the pillars are on a same plane to the first surface of the first substrate and are in contact with the first surface of the second substrate, wherein the pillars are disposed with space from one another.

3. The method of claim 2, wherein the pillars are coated with the organic thin film, except their top surface which is in contact with the first surface of the second substrate.

4. The method of claim 1, wherein the second substrate includes a polydimethylsiloxane.

5. The method of claim 1, wherein the first substrate includes Si, $SiO_2$, SiN, or a polymer.

6. The method of claim 1, wherein the organic thin film includes an organosilane-based material.

7. The method of claim 6, wherein the organosilane-based material comprises an alkoxysilane group or a chlorosilane group.

8. The method of claim 1, wherein the removing of the organic thin film comprises:

forming a photo mask which includes a flat transparent plate, a patterned photoresist layer, and a photocatalyst layer including a photocatalyst material, wherein the patterned photoresist layer is formed on one surface of the flat transparent plate and the photocatalyst layer is formed on an opposite surface of the transparent plate;

aligning the photo mask onto the first surface of the first substrate to bring the photocatalyst layer in contact with the organic thin film of the first surface of the first substrate; and irradiating rays to the photo mask to decompose parts of the organic thin film that contact the photocatalyst layer.

9. The method of claim 1, wherein the removing of the organic thin film comprises:

placing a patterned flat photocatalyst plate including a photocatalyst material on the first substrate on which the organic thin film is formed; and irradiating rays to the photocatalyst plate to decompose parts of the organic thin film that contacts the photocatalyst plate.

10. The method of claim 1, further comprising:

forming a photocatalyst layer including a photocatalyst material on the first surface of the first substrate, prior to the forming of the organic thin film so that the organic thin film is formed on the photocatalyst layer, wherein the removing of the organic thin film comprises:

forming a photo mask including a flat transparent plate and a patterned photoresist layer formed on the transparent plate;

aligning the photo mask on the first surface of the first substrate; and irradiating rays to the photo mask to decompose parts of the organic thin film that contact the photocatalyst layer.

11. The method of claim 1, wherein the first substrate includes a photocatalyst material.

12. The method of claim 11, wherein the photocatalyst material is $TiO_2$.

13. The method of claim 1, further comprising:

forming an oxide layer or a nitride layer on portions of the first surface of the first substrate, which contact the first surface of the second substrate, prior to the forming of the organic thin film.

14. The method of claim 13, wherein the oxide layer includes $SiO_2$ or $TiO_2$, and the nitride layer includes SiN.

* * * * *